US006676899B2

(12) United States Patent
Davydov et al.

(10) Patent No.: US 6,676,899 B2
(45) Date of Patent: Jan. 13, 2004

(54) NON-HARDENABLE ALUMINUM ALLOY AS A SEMI-FINISHED PRODUCT FOR STRUCTURES

(75) Inventors: Valentin Georgijevich Davydov, Moskau (RU); Yuri Filatov, Moskau (RU); Blanka Lenczowski, Neubiberg (DE); Viktor Yelagin, Moskau (RU); Valeri Zakarov, Moskau (RU)

(73) Assignee: Eads Deutschland GmbH, München (DE)

( * ) Notice: Subject to any disclaimer, the term of this patent is extended or adjusted under 35 U.S.C. 154(b) by 0 days.

(21) Appl. No.: 10/204,658

(22) PCT Filed: Dec. 14, 2001

(86) PCT No.: PCT/EP01/14797

§ 371 (c)(1),
(2), (4) Date: Nov. 12, 2002

(87) PCT Pub. No.: WO02/50325

PCT Pub. Date: Jun. 27, 2002

(65) Prior Publication Data

US 2003/0156967 A1 Aug. 21, 2003

(30) Foreign Application Priority Data

Dec. 21, 2000 (EP) ..... 00128050

(51) Int. Cl.[7] ..... C22C 21/06

(52) U.S. Cl. ..... 420/532; 420/543; 420/544; 420/535; 148/439; 148/440

(58) Field of Search ..... 420/532, 543, 420/544, 533, 534, 535; 148/439, 440

(56) References Cited

U.S. PATENT DOCUMENTS 6,531,004 B1 * 3/2003 Lenczowski et al. ..... 148/439

FOREIGN PATENT DOCUMENTS

| | | |
|---|---|---|
| DE | 198 38 018 | 3/2000 |
| FR | 2 717 827 | 9/1995 |
| RU | 2 085 607 | 7/1997 |
| WO | WO 00/11232 A1 * | 3/2000 |

* cited by examiner

*Primary Examiner*—George Wyszomierski
*Assistant Examiner*—Janelle Combs Morillo
(74) *Attorney, Agent, or Firm*—Kenyon & Kenyon

(57) ABSTRACT

A chemical composition of alloys, in particular naturally hard semifinished-material alloys, which are intended to be used in this form as material for semifinished materials. A naturally hard aluminum alloy for semifinished materials which, in addition to magnesium, titanium, beryllium, zirconium, scandium, and cerium, is also made of manganese, copper, zinc, and an element group containing iron and silicon, the ratio of iron to silicon being in the range of 1 to 5.

1 Claim, 2 Drawing Sheets

| Alloy | Composition | Chemical Composition, Weight % | | | | | | | | | | | | |
|---|---|---|---|---|---|---|---|---|---|---|---|---|---|---|
| | | Magnesium | Titanium | Beryllium | Zirconium | Scandium | Cerium | Manganese | Copper | Zinc | Iron | Silicon | Iron/Silicon*) | Aluminum |
| Alloy of the Present Invention | 1 | 5.0 | 0.01 | 0.0001 | 0.05 | 0.18 | 0.001 | 0.05 | 0.05 | 0.05 | 0.02 | 0.02 | 1 | Balance |
| | 2 | 5.3 | 0.03 | 0.003 | 0.1 | 0.24 | 0.002 | 0.12 | 0.1 | 0.1 | 0.10 | 0.03 | 3.33 | Balance |
| | 3 | 5.6 | 0.05 | 0.005 | 0.15 | 0.30 | 0.004 | 0.18 | 0.15 | 0.15 | 0.2 | 0.04 | 5 | Balance |
| Expanded Level of the Elements | | | | | | | | | | | | | | |
| | 4 | 4.5 | 0.005 | 0.00005 | 0.01 | 0.12 | 0.0005 | 0.02 | 0.01 | 0.01 | 0.01 | 0.02 | 0.5 | Balance |
| | 5 | 6.0 | 0.1 | 0.01 | 0.2 | 0.36 | 0.008 | 0.25 | 0.25 | 0.25 | 0.5 | 0.08 | 6.25 | Balance |
| | | | | | | | | | | | | | | |
| Known Alloy | | | | | | | | | | | | | | |
| | 6 | 4.4 | 0.05 | 0.003 | 0.1 | 0.3 | 0.002 | - | - | - | - | - | - | Balance |
| | | | | | | | | | | | | | | |

*) Ratio of iron content to silicon content

| Alloy | Composition | Chemical Composition, Weight % | | | | | | | | | | | | |
|---|---|---|---|---|---|---|---|---|---|---|---|---|---|---|
| | | Magnesium | Titanium | Beryllium | Zirconium | Scandium | Cerium | Manganese | Copper | Zinc | Iron | Silicon | Iron/Silicon*) | Aluminum |
| Alloy of the Present Invention | 1 | 5.0 | 0.01 | 0.0001 | 0.05 | 0.18 | 0.001 | 0.05 | 0.05 | 0.05 | 0.02 | 0.02 | 1 | Balance |
| | 2 | 5.3 | 0.03 | 0.003 | 0.1 | 0.24 | 0.002 | 0.12 | 0.1 | 0.1 | 0.10 | 0.03 | 3.33 | Balance |
| | 3 | 5.6 | 0.05 | 0.005 | 0.15 | 0.30 | 0.004 | 0.18 | 0.15 | 0.15 | 0.2 | 0.04 | 5 | Balance |
| Expanded Level of the Elements | | | | | | | | | | | | | | |
| | 4 | 4.5 | 0.005 | 0.00005 | 0.01 | 0.12 | 0.0005 | 0.02 | 0.01 | 0.01 | 0.01 | 0.02 | 0.5 | Balance |
| | 5 | 6.0 | 0.1 | 0.01 | 0.2 | 0.36 | 0.008 | 0.25 | 0.25 | 0.25 | 0.5 | 0.08 | 6.25 | Balance |
| | | | | | | | | | | | | | | |
| Known Alloy | | | | | | | | | | | | | | |
| | 6 | 4.4 | 0.05 | 0.003 | 0.1 | 0.3 | 0.002 | - | - | - | - | - | - | Balance |
| | | | | | | | | | | | | | | |

*) Ratio of iron content to silicon content

Fig. 1

| Alloy | Composition | Properties of the Heat–Treated Sheets | | | | | |
|---|---|---|---|---|---|---|---|
| | | $R_m$ [MPa] | $R_{p0,2}$ [MPa] | A [%] | LCF [cycles] ($K_t$ = 2.5; $\sigma_{max}$ = 160 MPa) | da/dN, [mm/cycle] ($\Delta K$ = 31.2 MPa $\sqrt{m}$) | $K_c$ [MPa $\sqrt{m}$] (B = 160 mm) |
| Alloy of the Present Invention | 1 | 390 | 275 | 17 | $150 \cdot 10^3$ | $2.3 \cdot 10^{-3}$ | 62 |
| | 2 | 400 | 280 | 16 | $140 \cdot 10^3$ | $2.5 \cdot 10^{-3}$ | 63 |
| | 3 | 410 | 290 | 15 | $140 \cdot 10^3$ | $3.3 \cdot 10^{-3}$ | 62 |
| Expanded Level of the Elements | 4 | 370 | 260 | 18 | $130 \cdot 10^3$ | $3.8 \cdot 10^{-3}$ | 62 |
| | 5 | 420 | 315 | 13 | $110 \cdot 10^3$ | $4.0 \cdot 10^{-3}$ | 60 |
| Known Alloy | 6 | 380 | 275 | 15 | $130 \cdot 10^3$ | $3.8 \cdot 10^{-3}$ | 62 |

Fig. 2

NON-HARDENABLE ALUMINUM ALLOY AS A SEMI-FINISHED PRODUCT FOR STRUCTURES

FIELD OF THE INVENTION

The present invention relates to a composition of alloys, such as naturally hard semifinished-material alloys, which are intended to be used in this form as material for structures.

BACKGROUND INFORMATION

Naturally hard aluminum alloys are used in metallurgy as semifinished materials for structures (see for example GOST standard 4784-74), but primarily in the form of AMg6 alloy, which contains the following (in percent by weight):

| | |
|---|---|
| magnesium | 5.8–6.8 |
| manganese | 0.5–0.8 |
| titanium | 0.02–0.1 |
| beryllium | 0.0002–0.005 |
| aluminum | balance |

This alloy, however, does not have adequate physical properties, in particular a low 0.2% yield strength in the case of cold-formed and hot-formed semifinished materials.

A naturally hard aluminum alloy, which is used as a semifinished material for structures (see Russian Patent No. 2085607, IPC class C22 C 21/06), provides the following chemical composition (% by weight):

| | |
|---|---|
| magnesium | 3.9–4.9 |
| titanium | 0.01–0.1 |
| beryllium | 0.0001–0.005 |
| zirconium | 0.05–0.15 |
| scandium | 0.20–0.50 |
| cerium | 0.001–0.004 |
| aluminum | balance |

This alloy does not have sufficient static and dynamic strength, while having high processibility during the manufacturing process, high corrosion resistance, good weldability, and a high readiness for operation under low-temperature conditions.

SUMMARY

The present invention is a new, naturally hard aluminum alloy for semifinished materials which, in addition to magnesium, titanium, beryllium, zirconium, scandium, and cerium, is also made of manganese, copper, zinc, and an element group containing iron and silicon, in the following composition of the components (weight %), the ratio of iron to silicon being in the range of 1 to 5:

| | |
|---|---|
| magnesium | 5.0–5.6 |
| titanium | 0.01–0.05 |
| beryllium | 0.0001–0.005 |
| zirconium | 0.05–0.15 |
| scandium | 0.18–0.30 |
| cerium | 0.001–0.004 |
| manganese | 0.05–0.18 |
| copper | 0.05–0.15 |

-continued

| | |
|---|---|
| zinc | 0.05–0.15 |
| element group including iron and silicon | 0.04–0.24 |
| aluminum | balance |

BRIEF DESCRIPTION OF THE DRAWINGS

FIG. 1 is a table of compositions of example embodiments of the present invention.

FIG. 2 is a table of properties of compositions of example embodiments of the present invention.

DETAILED DESCRIPTION

The alloy of the present invention is distinguished from other alloys by an addition of manganese, copper, zinc, and an element group containing iron and silicon, the components having the following proportions in weight percent, and with the ratio of iron to silicon between 1 and 5:

| | |
|---|---|
| magnesium | 5.0–5.6 |
| titanium | 0.01–0.05 |
| beryllium | 0.0001–0.005 |
| zirconium | 0.05–0.15 |
| scandiumt | 0.18–0.30 |
| cerium | 0.001–0.004 |
| manganese | 0.05–0.18 |
| copper | 0.05–0.15 |
| zinc | 0.05–0.15 |
| element group including iron and silicon | 0.04–0.24 |
| aluminum | balance |

This alloy provides an improvement of the static and dynamic physical properties of the alloy. This results in the improvement of the service life, operational reliability, and weight value of the structures subjected to static and dynamic loads improve, in particular those of the structures of various aircraft and spacecraft, including craft that burn cryogenic fuel.

Due to the proportions of the present invention between the chemical levels and the chemical constituents, the alloy has a ductile matrix, which comprises a solid solution of dissolved magnesium, maganese copper, and zinc in aluminum.

The capability of the alloy for operation under cyclical dynamic loads is due to the high ductility of the matrix. Secondary precipitation of finely distributed intermetallic particles, which contain aluminum, scandium, zirconium, titanium, and other transition metals occurring in the alloy, provides for both the high static strength of the alloy and a high resistance to crack propagation during fatigue testing. The setpoint value of the ratio of iron to silicon optimizes the morphology of the primary intermetallic compounds, which result from the solidification, are principally made of aluminum, iron, and silicon, and provide for an improvement in the static strength of the alloy, while the dynamic strength and plasticity are maintained.

EXAMPLE

Using A85 aluminum, MG90 magnesium, copper MO, zinc TsO, binary key alloys such as aluminum-titanium, aluminum-beryllium, aluminum-zirconium, aluminum-scandium, aluminum-cerium, aluminum-manganese, aluminum-iron, and silumin as an additive, a melt was prepared in an electric oven, on which 165×550 mm flat ingots of the alloy according to the present invention were cast with the aid of semicontinuous casting techniques (Table 1); the ingots having a minimum (composition 1), optimum (composition 2), and maximum (composition 3) proportion of constituents, including proportions of the constituents going beyond the present limitations (compositions 4 and 5), as well as the conventional alloy (composition 6) (see FIG. 1).

If the alloy is prepared under metallurgical production conditions, then scrap metal made of aluminum-magnesium alloys may be used as an additive.

The ingots were homogenized and machined to a thickness of 140 mm. They were subsequently hot-rolled to a thickness of 7 mm at a temperature of 400° C. and then cold-rolled to a thickness of 4 mm. The cold-rolled sheets were heat-treated in an electric oven. The heat-treated sheets were used as test material.

Standard transverse specimens removed from the sheets were used to determine the static tensile strength ($R_m$, $R_{p0,2}$, A) and the dynamic strength:

number of cycles to failure (N) in determining the low cycle fatigue (LCF), for which specimens having a notch factor of $K_t$=2.5 and a maximum stress σhd max=160 MPa are used;

crack-propagation rate da/dN in a range of the stress intensity factor ΔK=31.2 $MPam^{0.5}$, critical stress intensity factor $K_C$ in the state of planar stress, the width (B) of the specimen being 160 mm.

All tests were conducted at room temperature.

The test results are listed in FIG. 2.

Table 2 verifies that the alloy of the present invention has a higher static and dynamic strength than the conventional alloy. This allows for a reduction of the weight of the structures made of the alloy according to the present invention by 10 to 15%, in order to reduce operating costs, which is particularly important to the aircraft industry. The high readiness of the alloy according to the present invention to operate under static and dynamic conditions, as well as the fact that the alloy according to the present invention is a naturally hard alloy having a high corrosion resistance and good weldability, allows one to use it for the construction of completely new aircraft and spacecraft, sea-going vessels, land-bound vehicles, and other vehicles wherein structural elements are joined by welding. The alloy according to the present invention may be used as base material in welded structures, and as a welding additive for welded connections.

TABLE 1

| | | Chemical Composition, Weight % | | | | | | | | | | | | |
|---|---|---|---|---|---|---|---|---|---|---|---|---|---|---|
| Alloy | Composition | Magnesium | Titanium | Beryllium | Zirconium | Scandium | Cerium | Manganese | Copper | Zinc | Iron | Silicon | Iron/Silicon*) | Aluminum |
| Alloy of the Present Invention | 1 | 5.0 | 0.01 | 0.0001 | 0.05 | 0.18 | 0.001 | 0.05 | 0.05 | 0.05 | 0.02 | 0.02 | 1 | Balance |
| | 2 | 5.3 | 0.03 | 0.003 | 0.1 | 0.24 | 0.002 | 0.12 | 0.1 | 0.1 | 0.10 | 0.03 | 3.33 | Balance |
| | 3 | 5.6 | 0.05 | 0.005 | 0.15 | 0.30 | 0.004 | 0.18 | 0.15 | 0.15 | 0.2 | 0.04 | 5 | Balance |
| Expanded Level of the Elements | 4 | 4.5 | 0.005 | 0.00005 | 0.01 | 0.12 | 0.0005 | 0.02 | 0.01 | 0.01 | 0.01 | 0.02 | 0.5 | Balance |
| | 5 | 6.0 | 0.1 | 0.01 | 0.2 | 0.36 | 0.008 | 0.25 | 0.25 | 0.25 | 0.5 | 0.08 | 6.25 | Balance |
| Known Alloy | 6 | 4.4 | 0.05 | 0.003 | 0.1 | 0.3 | 0.002 | — | — | — | — | — | — | Balance |

*)Ratio of iron content to silicon content

TABLE 2

| | | Properties of the Heat-Treated Sheets | | | | | |
|---|---|---|---|---|---|---|---|
| Alloy | Composition | $R_m$ [MPa] | $R_{p0.2}$ [MPa] | A [%] | LCF [cycles] ($K_t$ = 2.5; $\sigma_{max}$ = 160 MPa) | da/dN, [mm/cycle] (ΔK = 31.2 MPa √m) | $K_c$ [MPa √m] (B = 160 mm) |
| Alloy of the Present Invention | 1 | 390 | 275 | 17 | $150 \cdot 10^3$ | $2.3 \cdot 10^{-3}$ | 62 |
| | 2 | 400 | 280 | 16 | $140 \cdot 10^3$ | $2.5 \cdot 10^{-3}$ | 63 |
| | 3 | 410 | 290 | 15 | $140 \cdot 10^3$ | $3.3 \cdot 10^{-3}$ | 62 |
| Expanded Level of the Elements | 4 | 370 | 260 | 18 | $130 \cdot 10^3$ | $3.8 \cdot 10^{-3}$ | 62 |
| | 5 | 420 | 315 | 13 | $110 \cdot 10^3$ | $4.0 \cdot 10^{-3}$ | 60 |
| Known Alloy | 6 | 380 | 275 | 15 | $130 \cdot 10^3$ | $3.8 \cdot 10^{-3}$ | 62 |

What is claimed is:

1. A naturally hard aluminum alloy as a semifinished material for a structure, comprising:

magnesium from 5.0 to 5.6 weight percent;

titanium from 0.01 to 0.05 weight percent beryllium from 0.0001 to 0.005 weight percent;

zirconium from 0.05 to 0.15 weight percent;

scandium from 0.18 to 0.30 weight percent;

cerium from 0.001 to 0.004 weight percent;

manganese from 0.05 to 0.18 weight percent;

copper from 0.05 to 0.15 weight percent;

zinc from 0.05 to 0.15 weight percent;

0.04 to 0.24 weight percent total iron and silicon, a ratio of iron to silicon in a range of 1 to 5; and a balance of aluminum.

* * * * *

UNITED STATES PATENT AND TRADEMARK OFFICE

CERTIFICATE OF CORRECTION

PATENT NO. : 6,676,899 B2 
DATED : January 13, 2004
INVENTOR(S) : Davydov et al.

It is certified that error appears in the above-identified patent and that said Letters Patent is hereby corrected as shown below:

Column 2,
Line 28, change "scandiumt" to -- scandium --;
Line 47, change "maganese" insert -- manganese, --;

Column 4,
Line 1, change "δhd" to -- $\delta_{max}$ --;
Line 2, change "max=160" insert -- =160 --;
Line 4, after "$MPam^{0.5}$" delete "," and insert -- ; --;
Table Z, (fourth column header), change "$R_{p0.2}$" to -- $R_{p0,2}$ --

Signed and Sealed this

Eighteenth Day of January, 2005

JON W. DUDAS
*Director of the United States Patent and Trademark Office*